United States Patent [19]

Leonard

[11] 4,090,958

[45] May 23, 1978

[54] COAL PROCESSING SYSTEM FOR PRODUCING A STREAM OF FLOWABLE INSOLUBLE COAL PRODUCTS

[75] Inventor: Robert Edward Leonard, Oklahoma City, Okla.

[73] Assignee: Kerr-McGee Corporation, Oklahoma City, Okla.

[21] Appl. No.: 660,334

[22] Filed: Feb. 23, 1976

[51] Int. Cl.[2] ..... B01D 21/00

[52] U.S. Cl. ..... 210/54; 208/8

[58] Field of Search ..... 208/8; 210/54

[56] References Cited

U.S. PATENT DOCUMENTS

| | | | |
|---|---|---|---|
| 2,476,999 | 7/1949 | Orchin | 208/8 |
| 3,018,241 | 1/1962 | Gorin | 208/8 |
| 3,375,188 | 3/1968 | Bloomer | 208/8 |
| 3,607,716 | 9/1971 | Roach | 208/8 |
| 3,607,717 | 9/1971 | Roach | 208/8 |
| 3,791,956 | 2/1974 | Gorin et al. | 208/8 |
| 3,852,183 | 12/1974 | Snell | 208/8 |
| 3,856,675 | 12/1974 | Sze et al. | 208/8 |
| 3,954,595 | 5/1976 | Sze et al. | 208/10 |
| 3,974,073 | 8/1976 | Sze et al. | 208/8 |

OTHER PUBLICATIONS

Selvig et al., "Analyses of Ash from U.S. Coals", Bulletin No. 567, Bureau of Mines, 1956.

*Primary Examiner*—Delbert E. Gantz
*Assistant Examiner*—James W. Hellwege
*Attorney, Agent, or Firm*—William G. Addison

[57] ABSTRACT

An improved coal processing system wherein a feed mixture (including coal, dissolving solvent, insoluble coal products and soluble coal products) at a first temperature level is separated in a first separation zone into a heavy fraction including the insoluble coal products and a light fraction and, thereafter, the heavy fraction is withdrawn from the first separation zone and heated to a second temperature level higher than the first temperature level and in which the second temperature level is sufficiently high to produce a heavy fraction that is flowable.

10 Claims, 2 Drawing Figures

COAL PROCESSING SYSTEM FOR PRODUCING A STREAM OF FLOWABLE INSOLUBLE COAL PRODUCTS

BACKGROUND OF THE INVENTION

1. Field of the Invention

The present invention relates generally to the liquefaction and fractionation of hydrocarbonaceous materials and, more particularly, but not by way of limitation, to an improved system for producing a flowable, insoluble coal fraction.

2. Description of the Prior Art

Various coal processing systems have been developed in the past wherein coal has been treated with one or more solvents and processed to separate the resulting insoluble coal products from the soluble coal products, some systems including provisions for recovering the solvents.

U.S. Pat. Nos. 3,607,716 and 3,607,717, issued to Roach and assigned to the same assignee as the present invention, disclose processes wherein coal is contacted with a solvent and the resulting mixture then is separated into a heavy phase containing the insoluble coal products and a light phase containing the soluble coal products. In such processes, the light phase is withdrawn and passed to downstream fractionating vessels wherein the soluble coal product is separated into multiple fractions. Other processes for separating the soluble coal products from the insoluble coal products utilizing one or more solvents are disclosed in U.S. Pat. No. 3,607,718, and 3,642,608, both issued to Roach et al., and assigned to the same assignee as the present invention.

BRIEF DESCRIPTION OF THE DRAWING

The two sheets of the drawing illustrate diagrammatically the presently preferred arrangement of apparatus for practicing the process of the present invention.

DESCRIPTION OF THE PREFERRED EMBODIMENTS

Figure 1A:
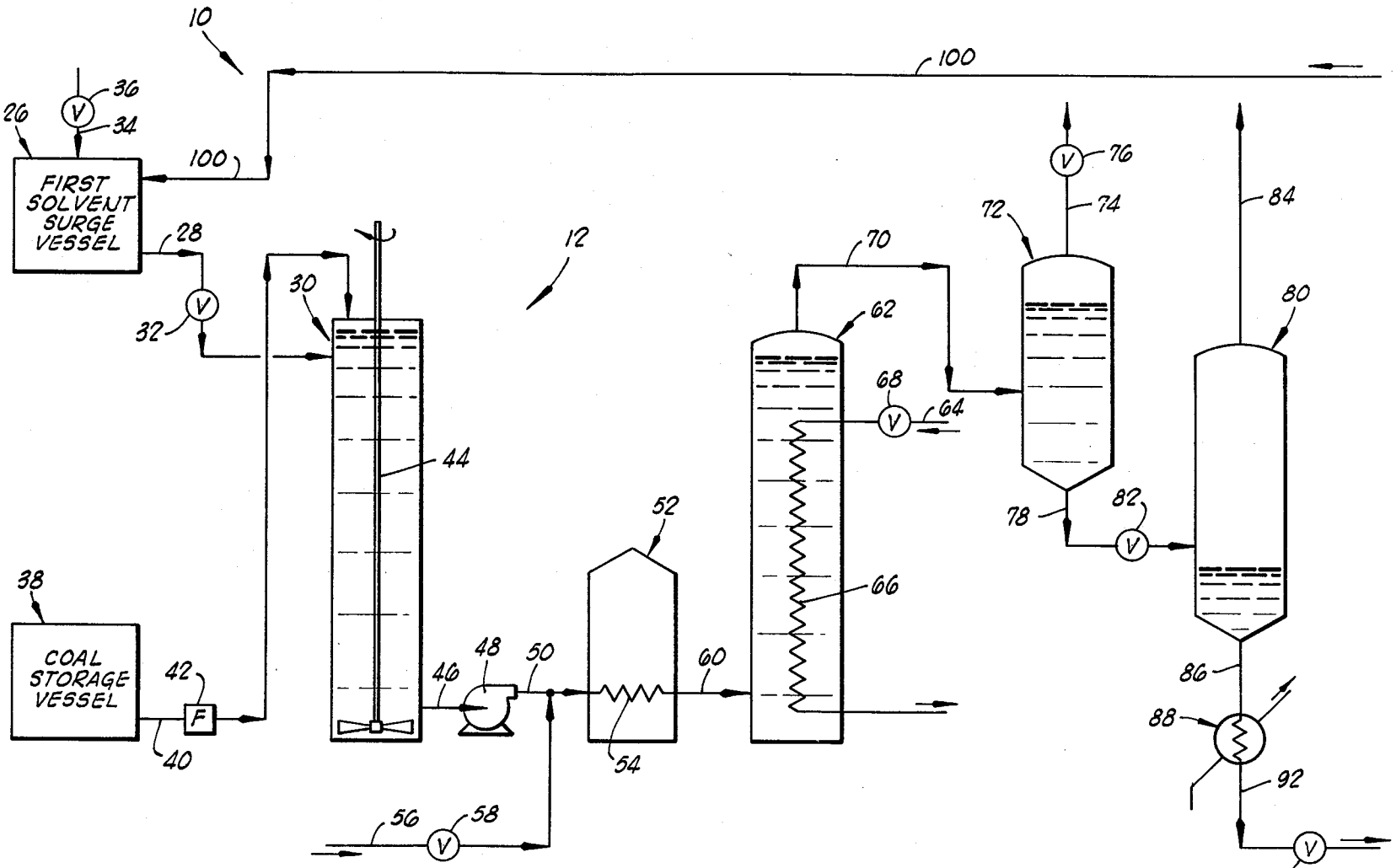
Figure 1:
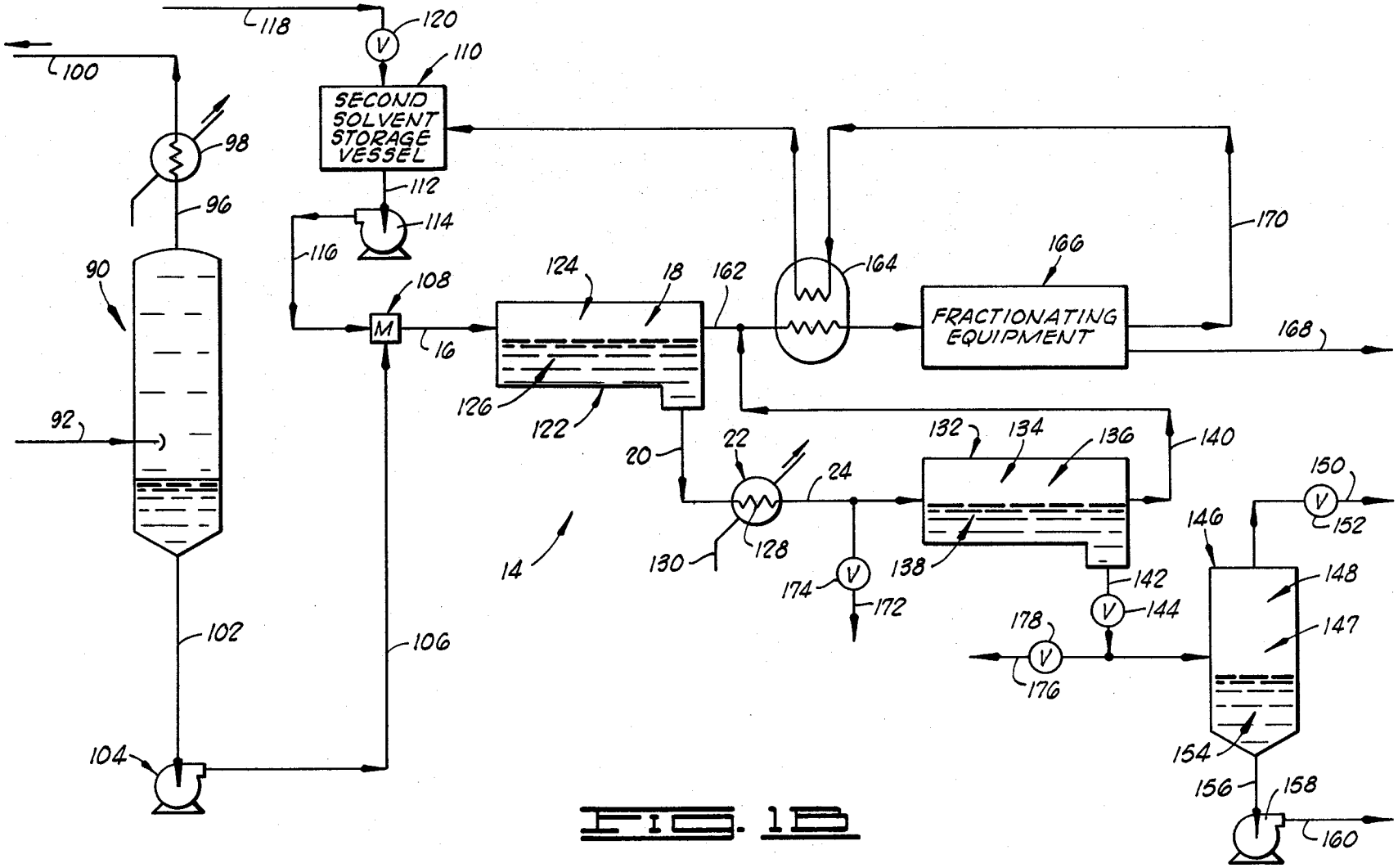

Referring now to the drawing (FIGS. 1A and 1B), general reference numeral 10 designates a coal processing system arranged in accordance with the present invention and generally including a first system 12 and a second system 14. In general, coal to be processed in accordance with this invention is contacted with a dissolving solvent and processed through the first system 12 to provide a feed mixture comprising the dissolving solvent, insoluble coal products and soluble coal products.

The term "insoluble coal products" as used herein refers to the undissolved coal, ash, other solid inorganic particulate matter and other such matter which is insoluble in the dissolving solvent.

The feed mixture is passed from the first system 12 to the second system 14 via a conduit 16 wherein the feed mixture is separated in a first separation zone 18 at a first temperature level into a first heavy fraction comprising substantially the insoluble coal products and a first light fraction comprising substantially the soluble coal products and the dissolving solvent. The first heavy fraction is withdrawn from the first separation zone 18 through a conduit 20 and passed through a heater 22 wherein it is heated to a second temperature level higher than the first temperature level, the second temperature level being sufficiently high to produce a flowable first heavy fraction which is withdrawn from the first separation zone 18 and which is capable of being passed downstream from the heater 22 via a conduit 24 in a more efficient and more economical manner than possible heretofore.

The yield of soluble coal products is influenced by the first temperature level, i.e. the temperature level within the first separation zone 18. Thus, as the first temperature level is increased, the solubility of the soluble coal products reduces thereby reducing the yield of the desired soluble coal products. Therefore, it is desirable to maintain the first temperature level as low as feasible to obtain the greatest yield of the desirable soluble coal products in the overhead first light fraction within the first separation zone 18; however, it has been discovered that the viscosity of the first heavy fraction to be withdrawn from the first separation zone 18 increases to a level wherein the flowability of that first heavy fraction is substantially reduced and, in many systems, the flowability of the first heavy fraction is reduced to such a level that the first heavy fraction cannot be passed downstream from the first separation zone 18 in an efficient manner. Moreover, in many instances, the high viscosity of the heavy fraction tends to foul or clog the conduit 20 and the downstream apparatus.

Thus, it will be appreciated that a conflict exists between selecting a relatively low first temperature level in the first separation zone 18 to permit the highest possible yield of the desired soluble coal products and maintaining the temperature level of the first heavy fraction sufficiently high to produce a first heavy fraction which is flowable to decrease substantially the possibilities of fouling or clogging of downstream apparatus.

The first heavy fraction withdrawn from the first separation zone 18 will contain some amount of the dissolving solvent. The conflict between the first temperature level and the desirable temperature level of the first heavy fraction withdrawn from the first separation zone 18, to maintain the withdrawn first heavy fraction in a flowable condition, is aggravated by the inherent characteristics of the dissolving solvent to flash out of the withdrawn first heavy fraction as the pressure on the withdrawn first heavy fraction is reduced, since the flashing of the dissolving solvent results in a reduction of the temperature level of the withdrawn first heavy fraction.

In one aspect, the present invention resolves the conflicts and problems generally described above by establishing the first temperature level of the feed mixture in the first separation zone 18 at a level for optimizing the yield of the soluble coal products in the first light fraction followed by heating the first heavy fraction withdrawn from the first separation zone 18 in the heater 22 to a second temperature level which is higher than the first temperature level and sufficiently high to produce a flowable first heavy fraction, which is discharged from the heater 22 and passed into the conduit 24 to the downstream apparatus.

Referring more particularly to the first system 12, a first dissolving solvent is passed from a first solvent surge vessel 26 through a conduit 28 and into a mixer 30 at a rate of flow controlled by a valve 32 interposed in the conduit 28. Make-up first dissolving solvent is supplied to the first solvent surge vessel 26 through a conduit 34 when a valve 36, interposed in the conduit 34, is opened.

Pulverized coal is contained in a coal storage vessel 38 and is passed into the mixer 30 through a conduit 40 at a rate controlled by a solids feeder 42 interposed in the conduit 40. The feed rates of the first dissolving solvent and the pulverized coal preferably are controlled to maintain the weight ratio of the first dissolving solvent to coal in the mixer 30 within a range between about one-to-one and about twenty-to-one. More particularly, it has been found desirable to maintain the weight ratio of first dissolving solvent to coal in the mixer 30 in a range between about two-to-one and about five-to-one; best results have been obtained when the weight ratio was maintained at about three-to-one.

In mixer 30, the coal and the first dissolving solvent are agitated with a stirring mechanism 44 at about ambient temperature and pressure to form a slurry. That slurry is withdrawn from mixer 30 through a conduit 46 by a pump 48, the slurry being discharged from the pump 48 through a conduit 50 to a heater 52 where the slurry is heated in a coil 54. In one preferred form, gaseous hydrogen is passed from a source (not shown) through a conduit 56 connected to the conduit 50, the gaseous hydrogen is mixed with the slurry flowing through the conduit 50 and the resulting mixture is heated via the heater 52. A valve 58 is interposed in the conduit 56 and thus the gaseous hydrogen is mixed with the slurry flowing through the conduit 50 when the valve 58 is opened.

The slurry in the conduit 50, which may include the gaseous hydrogen, is discharged from the heater 52 and passed through a conduit 60 into a liquefier 62. In one embodiment, the pressure level in liquefier 62 (sometimes referred to herein as the "liquefaction pressure") is greater than about 1000 psig and preferrably in the range of about 1200 psig to about 1500 psig. The temperature level of the slurry in the liquefier 62 (sometimes referred to herein as the "liquefaction temperature level") is determined by the temperature level of the slurry in the conduit 60, which is passed into the liquefier 62, and the temperature level of the heating medium (gas or fluid) passed through a conduit 64 and through a heating coil 66 disposed within the liquefier 62, the rate of flow of the heating medium being controlled via a valve 68 interposed in the conduit 64. In the operational embodiment mentioned before, the temperature level in the liquefier 62 is about 800° F. and thus the heater 52 is designed to elevate the temperature level of the slurry passing therethrough to an elevated temperature level which preferably approximates the temperature level of the slurry in the liquefier 62, for example, about 800° F.

In the liquefier 62, the first dissolving solvent is contacted with the coal at the elevated liquefaction temperature and pressure for a period of time sufficient to solubilize the soluble constituents of the coal and produce a mixture of coal liquefaction products (the soluble coal products), the dissolving solvent and the insoluble coal products. The insoluble coal products consist largely of carbon and the ash mineral fraction of the coal.

The mixture of soluble coal products, insoluble coal products, first dissolving solvent and gases is withdrawn from the liquefier 62 and passed through a conduit 70 into a degassing vessel 72 wherein the mixture is degassed by permitting the excess hydrogen, other gases and vapors to be discharged from the degassing vessel 72 through a conduit 74, a pressure reducing valve 76 being interposed in the conduit 74. The pressure reducing valve 76 is utilized to control the pressure on the mixture within the degassing vessel 72. In some operational embodiments, the hydrogen containing gases are discharged through the conduit 74 and passed to a hydrogen recycle system for recovering such hydrogen. In this embodiment the temperature level of the mixture in the degassing vessel 72 is about 800° F. and the pressure level in the degassing vessel 72 is in the range of about 1200 psig to about 1500 psig.

The degassed mixture is discharged from the degassing vessel 72 through a conduit 78 and passed into a flash vessel 80, the rate of flow being controlled by a liquid level control type of valve 82 interposed in the conduit 78. In the operational embodiment referred to before, the pressure level in the flash vessel 80 is about one atmosphere or about 20 psig and the temperature level is in the range of about 500° to about 600° F. In the flash vessel 80 a substantial portion of the light organics, such as propane, hexane, toluene or benzene, for example, are flashed-off and discharged from the flash vessel 80 through the conduit 84, the light organics being recoverable in any suitable manner (not shown).

The mixture consisting essentially of the first dissolving solvent, the insoluble coal products and the soluble coal products in the lower portion of the flash vessel 80 is withdrawn through a conduit 86 and passed through a heater 88 wherein the temperature level of the mixture is elevated, the heated mixture being discharged from the heater 88 and passed into a vacuum flash column 90 (the vacuum source not shown in the drawing) via a conduit 92. A valve 94 is interposed in the conduit 92.

In the vacuum flash column 90, vapors, including those of the first dissolving solvent, are removed overhead and passed from the vacuum flash column 90 through a conduit 96 and a heat exchanger 98 wherein they are condensed. The condensed first dissolving solvent is returned to the first solvent surge vessel 26 via a conduit 100 (sometimes referred to herein as "the return first dissolving solvent"). The heater 88 essentially establishes the temperature level of the mixture in the vacuum flash column 90 at a level to control the amount of the first dissolving solvent passed from the vacuum flash column 90 through the conduit 100 as return first dissolving solvent.

In the example referred to before, the heater 88 heats the mixture passing therethrough to a level such that the temperature level of the mixture in the vacuum flash column 90 is about 650° F., the pressure level in the vacuum flash column 90 being about 2 psia. The temperature level of the vapors passing through the conduit 96 is about 600° F., the vapor temperature drop resulting primarily from the flashing of the first dissolving solvent in the vacuum flash column 90, and the temperature level of the condensed return first dissolving solvent passing from the heat exchanger 98 through the conduit 100 is about 200° F.

The vacuum bottoms in the lower portion of the vacuum flash column 90 are withdrawn through a conduit 102 by a pump 104. The vacuum bottoms consist essentially of the soluble coal products, the insoluble coal products and some of the first dissolving solvent, a large portion of the first dissolving solvent being flashed-off in the vacuum flash column and recovered as the return first dissolving solvent. The pump 104 discharges the mixture through a conduit 106 into a mixer 108 (sometimes referred herein as the "second mixer" and designated in the drawing via the symbol "M"). The temperature level of the mixture passing through the conduit 106 is about 600° F. and the pressure level is about 800 psig.

In the embodiment of the invention shown in the drawing, a second dissolving solvent is contained in a second solvent surge vessel 110. The second dissolving solvent is withdrawn from the vessel 110 through a conduit 112 and pumped by a pump 114 through a conduit 116 into the mixer 108. Make-up second dissolving solvent is added to the second solvent surge vessel 110 via conduit 118 and the flow of the make-up second dissolving solvent is controlled by a valve 120 interposed in the conduit 118. In the mixer 108, the mixture discharged from the conduit 106 is contacted by the second dissolving solvent discharged from the conduit 116 and the resulting mixture is discharged from the mixer 108 into and through the conduit 16, the mixture discharged from the mixer 108 comprising and being referred to herein as the "feed mixture" and being at a temperature level of about 630° F.

Thus, the embodiment shown in the drawing contemplates the utilization of two, different dissolving solvents, one of the dissolving solvents being introduced from the first solvent surge vessel 26 and sometimes referred to herein as the "first dissolving solvent", and one other dissolving solvent being introduced from the second solvent surge vessel 110 and sometimes referred to herein as the "second dissolving solvent". However, the present invention also contemplates systems wherein the coal is contacted by a single dissolving solvent or systems wherein the coal is contacted by more than two dissolving solvents. Therefore, the feed mixture passing through the conduit 16 and introduced into the first separation zone 18 is referred to herein as including the dissolving solvent, which may be second dissolving solvent or the first dissolving solvent or a combination of the first and the second dissolving solvents or some other dissolving solvent or solvents utilized in a system (not shown in the drawing) for producing the feed mixture, unless the dissolving solvent is particularly designated as the "first dissolving solvent" or the "second dissolving solvent".

Referring now more particularly to the second system 14, the first separation zone 18 comprises a first phase separating vessel 122 and, in the vessel 122, the feed mixture is separated to form the first light fraction in a upper portion 124 of the vessel 122 and the first heavy fraction in a lower portion 126 of the vessel 122, the first heavy fraction being allowed to settle within the lower portion 126 while the first light phase rises to the upper portion 124. In the particular embodiment referred to before, the temperature level in the first separation zone 18 (the first temperature level) is lower than about 680° F. and, more particularly, the first temperature level is about 630° F. The pressure level in the first separation zone 18 is higher than about 600 psig and in a range of about 600 psig to about 1500 psig. More particularly, the pressure level in the first separation zone 18 is about 800 psig.

The first heavy fraction is withdrawn from the first phase separating vessel 122 and passed through the heater 22 wherein the first heavy fraction is heated to the second temperature level. More particularly, the first heavy fraction is passed through a coil 128 in the heater 22 and a heating medium (a gas or a fluid) is passed through a conduit 130 in heat exchange relationship with respect to the first heavy fraction passing through the coil 128 to thereby elevate the temperature level of the first heavy fraction to the second temperature level. The heated first heavy fraction is discharged from the heater 22 into the conduit 24 and, at this stage in the process, the mixture in the conduit 24 is essentially a two phase system that is at a pressure level substantially equal to the pressure level of the first heavy fraction in the first separation zone 18, namely about 800 psig.

The heated first heavy fraction is passed from the heater 22 through the conduit 24 and into a second phase separating vessel 132 wherein the first heavy fraction is allowed to separate within a second separation zone 134 within the second phase separating vessel 132 to form a fluid-like second heavy fraction which accumulates in a lower portion 138 of the second phase separating vessel 134, and a second light fraction which rises to an upper portion 136. The second light fraction includes the dissolving solvent (primarily the second dissolving solvent in the embodiment shown in the drawing) and soluble coal products. This second light fraction is withdrawn from the second phase separating vessel 134 through a conduit 140.

The pressure level in the second separation zone 134 is slightly less than the pressure level in the first separation zone 18 and, more particularly, the pressure level in the second separation zone 134 is in the range of about 590 psig to about 1490 psig. The temperature level in the second separation zone 134 is about the same as the second temperature level, that is, about the same as the temperature level of the first heavy fraction which is discharged from the heater 22.

The second heavy fraction is withdrawn from the second phase separating vessel 132 through a conduit 142 at a flow rate controlled by a level control valve 144 interposed in the conduit 142. The level control valve 144 flashes the second heavy fraction to substantially atmospheric pressure, and a stream, which is essentially, a two phase system, passes from the level control valve 144 into a third phase separating vessel 146 (diagrammatically shown in the drawing as a conventional cyclone separator type of separating vessel). The pressure level in the third phase separatint vessel 146 is lower or below the pressure level in the second separation zone 134 and the temperature level in the third phase separating vessel 146 is in the range of about 500° to about 600° F.

The flashed second heavy fraction is separated in a third separation zone 147 formed in the third phase separating vessel 146 into an overhead third light solvent fraction and a bottom third heavy fraction. The overhead light solvent fraction rises to an upper portion 148 of the third phase separating vessel 146 and is withdrawn through a conduit 150, a valve 152 being interposed in the conduit 150. The overhead third light solvent fraction may be condensed and returned to the second solvent surge vessel 110, if desired.

The third heavy fraction which accumulates in a lower portion 154 of the third phase separating vessel 146 is withdrawn through a conduit 156 by a pump 158 and is discharged through a conduit 160 to downstream apparatus (not shown). The third heavy fraction withdrawn from the third phase separating vessel 146 comprises substantially all of the suspended particles of insoluble coal products contained in the feed mixture initially fed to the first phase separating vessel 122 via the conduit 16.

In the embodiment referred to before, the first heavy fraction is heated to the second temperature level of about 680° F. by the heater 22 to produce the flowable first heavy fraction in the conduit 24 and, because of such heating: (1) the first heavy fraction is maintained in a flowable condition as it is passed into the second separation zone 134; (2) the second heavy fraction is in a flowable condition within the second separation zone 134 (the pressure level in the second separation zone 134 being substantially the same as the pressure level in the first separation zone 18, namely about 800 psig); (3) the second heavy fraction also is flowable as it is flashed through the valve 144 and passed to the third separation zone 147; and (4) the third heavy fraction is flowable within the third separation zone 147 as it is withdrawn and pumped into the conduit 160. The temperature level of the second heavy fraction is reduced as a result of the flashing of the second heavy fraction in the valve 144 and, in this embodiment, the temperature level within the third separation zone 147 and the temperature level of the third heavy fraction withdrawn from the third separation zone 147 are each in a range of about 500° to about 600° F., the flowability of the third heavy fraction facilitating the pumping of the third heavy fraction by the pump 160.

In some applications, it may be desirable to withdraw the first heavy fraction from the conduit 24, thereby eliminating the separations accomplished within the second and the third phase separating vessels 132 and 146. In such applications, the first heavy fraction is withdrawn through a conduit 172 by opening a valve 174, interposed in the conduit 172. The conduit 172 can be connected directly to a pump (not shown) for pumping the first heavy fraction from the first phase separating vessel 122. In other applications, it may be desirable to pass the first heavy fraction directly into the third phase separating vessel 146 and, in such applications, the conduit 172 is connected to the conduit 142, thereby by-passing the second phase separating vessel 132.

In still other applications, it may be desirable to pump the second heavy fraction directly from the second phase separating vessel 132 and, in these applications, the second heavy fraction is withdrawn through a conduit 176 by opening a valve 178, interposed in the conduit 176. In this last-mentioned application, the conduit 176 can be connected to other downstream apparatus (not shown) or the conduit 176 can be connected to a pump (not shown) for pumping the second heavy fraction directly from the second phase separating vessel 132.

Thus, the present invention contemplates producing a flowable first, second and third heavy fraction, in one aspect; in another aspect, the invention contemplates producing a flowable first and third heavy fraction; in yet another aspect, the invention contemplates producing only a flowable first heavy fraction; and, in still another aspect, the invention contemplates producing a flowable first and second heavy fraction.

The first light fraction, which rises to the upper portion 124 of the first phase separating vessel 122, is a solvent-rich fraction comprising substantially the soluble coal products and the second dissolving solvent. The first light fraction is withdrawn from the first phase separating vessel 122 through a conduit 162 and passed through a heat exchanger 164 interposed in the conduit 162, to fractionating equipment designated in the drawing by the general reference numberal 166, the second light fraction in the conduit 140 being combined with the first light fraction in the conduit 162. In one embodiment, the fractionating equipment 166 is designed to separate the first light fraction into one or more coal liquefaction fractions (soluble coal products) which are discharged through a conduit 168 (the conduit 168 being two or more separate conduits in those systems where the soluble coat products are separated into more than one fraction with each individual fraction passing through one of the several conduits represented by the conduit 168 diagrammatically shown in the drawing).

The dissolving solvent passed into the fractionating equipment 166 via the conduit 162 is separated from the soluble coal products. The separated dissolving solvent is passed from the fractionating equipment 166 through a conduit 170, through the heat exchanger 164 and returned to the second solvent surge vessel 110 to thereby recover the dissolving solvent. The dissolving solvent returned to the second solvent surge vessel 110 from the fractionating equipment 166 sometimes is referred to herein as the "return second dissolving solvent" and substantially comprises the second dissolving solvent in the operational example shown in the drawing.

In the embodiment of the present invention shown in the drawing, the first dissolving solvent preferably is an organic solvent suitable for liquifying coal in the manner herein described. Various solvents suitable for use as the first dissolving solvent are described in detail in U.S. Pat. Nos. 3,607,716, 3,607,717, 3,607,718, and 3,642,608. The second dissolving solvent is of the type sometimes described as a "light organic solvent" in the just mentioned patents and consists essentially of at least one substance having a critical temperature below 800° F. selected from the group consisting of aromatic hydrocarbons having a single benzene nucleus and normal boiling points below about 310° F., cycloparaffin hydrocarbons having normal boiling points below about 310° F., open claim mono — olefin hydrocarbons having normal boiling points below about 310° F., open chain saturated hydrocarbons having normal boiling points below about 310° F.; mono-, di-, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

The term "flowable" as used herein to describe the condition of the heavy fraction (more particularly, the first heavy fraction or the second heavy fraction or the third heavy fraction depending on the particular stage in the system of the present invention) refers to the movability of the heavy fraction through a conduit wherein the heavy fraction is passed through such conduit via gravity, a pressure differential or other such similar means for passing streams through conduits or the like. In one more specific aspect, the term "flowability" refers to the viscosity of the heavy fraction and, in those applications wherein the first heavy fraction is withdrawn from the first separating zone 18 and heated to a second temperature level above about 630° F. at a pressure level of about 800 psig, the term "flowability" contemplates a heated first heavy fraction in the conduit 24 having a viscosity in the range of about 1000 centipoise to about 50,000 centipoise, for example. Further, referring to this specific aspect, the term "flowability" contemplates a second heavy fraction in the conduit 142 having a viscosity in the range of about 1000 centipoise to 50,000 centipoise, at a pressure level of about 800 psig and a temperature level of about 680° F., and a third heavy fraction in the conduit 156 having a viscosity in the range of about 4000 centipoise to 200,000 centipoise at a pressure level of about one atmosphere and a temperature level of about 500° F. to about 600° F. (The viscosity of the third heavy fraction being above about 500 centipoise).

It should be noted that the first heavy fraction may be heated in the first separation zone 18 before withdrawing the first heavy fraction, which may be desirable in some applications. In this particular embodiment, (not shown in the drawing), a heater is located within the first phase separating vessel 122 and, preferably, the heater is disposed near the outlet connection of the first phase separating vessel 122 for heating the first heavy fraction to the second temperature level immediately prior to withdrawing the first heavy fraction so the first temperature level in the first separation zone 18 is maintained lower than the second temperature level of the first heavy fraction to be withdrawn.

The particular example referred to herein specifically contemplates benzene as the second dissolved solvent although the various temperature and pressure levels specifically identified herein are applicable generally to other similar dissolving solvents.

Changes may be made in the process apparatus or in the steps of the process or in the sequence of the steps of the process of the present invention without departing from the spirit and scope of the invention as defined in the following claims.

What is claimed is:

1. A process comprising: providing a feed mixture comprising a dissolving solvent, insoluble coal products and soluble coal products, said dissolving solvent consisting essentially of at least one substance having a critical temperature below 800° F. selected from the group consisting of aromatic hydrocarbons having a single benzene nucleus and normal boiling points below about 310° F., cycloparaffin hydrocarbons having normal boiling points below about 310° F., open chain mono-olefin hydrocarbons having normal boiling points below about 310° F., open chain saturated hydrocarbons having normal boiling points below about 310° F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

introducing the feed mixture into a first separation zone;

maintaining the first separation zone at a first temperature level lower than about 680° F. and the pressure level in the first separation zone higher than about 600 psig;

separating the feed mixture in the first separation zone at the first temperature and pressure level into a first heavy fraction comprising the insoluble coal products and a light fraction comprising the soluble coal products;

withdrawing the first heavy fraction from the first separation zone;

heating the first heavy fraction to a second temperature level higher than the first temperature level to produce a flowable first heavy fraction;

passing the heated first heavy fraction into a second separation zone;

maintaining the second separation zone temperature level at about the same as the second temperature level and the pressure level in the second separation zone in a range of about 690 psig to about 1490 psig;

separating the first heavy fraction in the second separation zone into a second heavy fraction comprising the insoluble coal products and a second light fraction comprising a portion of the dissolving solvent; and withdrawing the second heavy fraction from the second separation zone, the second heavy fraction being flowable.

2. The process of claim 1 defined further to include the step of:

reducing the pressure level of the second heavy fraction after withdrawing such second heavy fraction from the second separation zone.

3. The process of claim 1 defined further to include the steps of:

passing the second heavy fraction into a third separation zone;

maintaining the temperature level in the third separation zone in a range of 500° F. to about 600° F. and the pressure level in the third separation zone below the pressure level in the second separation zone;

separating the second heavy fraction in the third separation zone into a third heavy fraction comprising the insoluble coal products and a third light fraction comprising a portion of the dissolving solvent; and withdrawing the third heavy fraction from the third separation zone, the third heavy fraction being flowable.

4. The process of claim 3 wherein the third heavy fraction is defined further as having a viscosity in the range of about 500 centipoise to about 200,000 centipoise.

5. The process of claim 1 wherein the pressure level in the first separation zone is in a range of about 600 psig to about 1500 psig.

6. The process of claim 1 wherein the first light fraction includes the dissolving solvent, and wherein the process is defined further to include the steps of:

withdrawing the first light fraction from the first separation zone;

recovering the dissolving solvent from the first light fraction; and withdrawing the soluble coal products from the first light fraction.

7. The process of claim 6 defined to include the step of:

passing the dissolving solvent recovered from the first light fraction into contact with the feed mixture.

8. The process of claim 1 wherein the first heavy fraction is defined further as having a viscosity in the range of about 1000 centipoise to about 50,000 centipoise.

9. The process of claim 1 wherein the second heavy fraction is defined further as having a viscosity in the range of about 1000 centipoise to about 50,000 centipoise.

10. A process comprising:

providing a feed mixture comprising a dissolving solvent, insoluble coal products and soluble coal products, said dissolving solvent consisting essentially of at least one substance having a critical temperature below 800° F. selected from the group consisting of aromatic hydrocarbons having a single benzene nucleus and normal boiling points below about 310° F., cycloparaffin hydrocarbons having normal boiling points below about 310° F., open chain mono-olefin hydrocarbons having normal boiling points below about 310° F., open chain saturated hydrocarbons having normal boiling points below about 310° F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

introducing the feed mixture into a first separation zone;

maintaining the first separation zone at a first temperature level lower than about 680° F. and the pressure level in the first separation zone higher than about 600 psig;

separating the feed mixture in the first separation zone at the first temperature and pressure level into a first heavy fraction comprising the insoluble coal products and a light fraction comprising the soluble coal products;

withdrawing the first heavy fraction from the first separation zone;

heating the first heavy fraction to a second temperature level higher than the first temperature level to produce a flowable first heavy fraction;

passing the first heavy fraction into another separation zone;

maintaining the temperature level in the said another separation zone in a range of from about 500° F. to about 600° F. and the pressure level below the pressure level in the first separation zone;

separating the first heavy fraction in said another separation zone into another heavy fraction comprising the insoluble coal products and another light fraction comprising a portion of the dissolving solvent; and withdrawing both fractions in flowable form.

* * * * *